US006227329B1

(12) United States Patent
Ador

(10) Patent No.: US 6,227,329 B1
(45) Date of Patent: May 8, 2001

(54) SAFETY LINE ANCHORAGE METHODS AND APPARATUS

(75) Inventor: Bernard R. Ador, Roquefort les Pins (FR)

(73) Assignee: Protecta International S.A., Carros Cedex (FR)

( * ) Notice: Subject to any disclaimer, the term of this patent is extended or adjusted under 35 U.S.C. 154(b) by 0 days.

(21) Appl. No.: 09/366,799

(22) Filed: Aug. 4, 1999

(51) Int. Cl.[7] ..... A62B 35/00
(52) U.S. Cl. ..... 182/3; 182/45; 182/36
(58) Field of Search ..... 182/3, 36, 45; 248/499

(56) References Cited

U.S. PATENT DOCUMENTS

D. 311,326 * 10/1990 Nelson ..... 248/499
3,937,436 * 2/1976 Stewart ..... 248/499
4,699,245 * 10/1987 Benedict ..... 182/36
5,287,944 * 2/1994 Woodyard ..... 182/45
5,320,193 * 6/1994 Bongiolanns ..... 182/45
5,850,889 * 12/1998 Rexroad ..... 182/3

* cited by examiner

*Primary Examiner*—Alvin Chin-Shue
(74) *Attorney, Agent, or Firm*—Mau & Krull, P.A.

(57) ABSTRACT

A base plate 110 is adapted to be secured to a support structure 20. A transverse plate 120 is secured to the base plate 110 and extends outward from the base plate 110. A slot 122 is formed in the transverse plate 120 to receive a ring 130. A notch 123 is formed in a sidewall of the slot 122 to seat the ring 130 within the slot 122. The ring 130 is adapted to anchor an end of a safety line 40 regardless of the orientation of the base plate 110 relative to the desired orientation of the safety line 40.

18 Claims, 3 Drawing Sheets

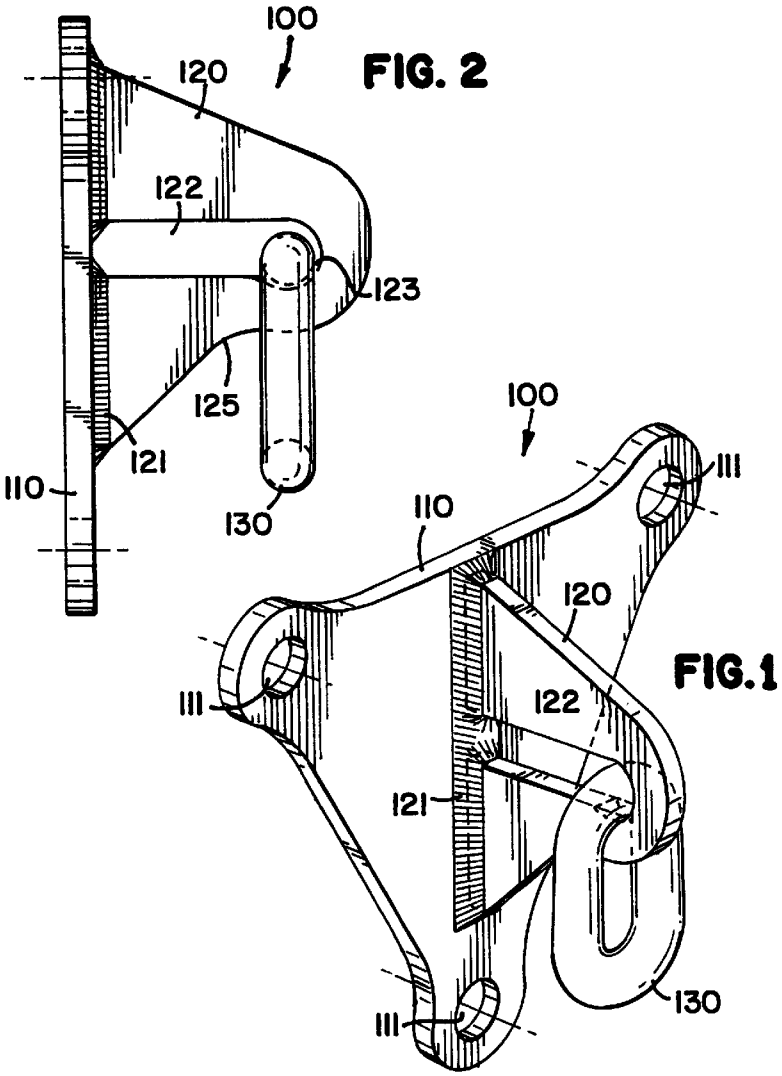
FIG. 2
FIG. 1
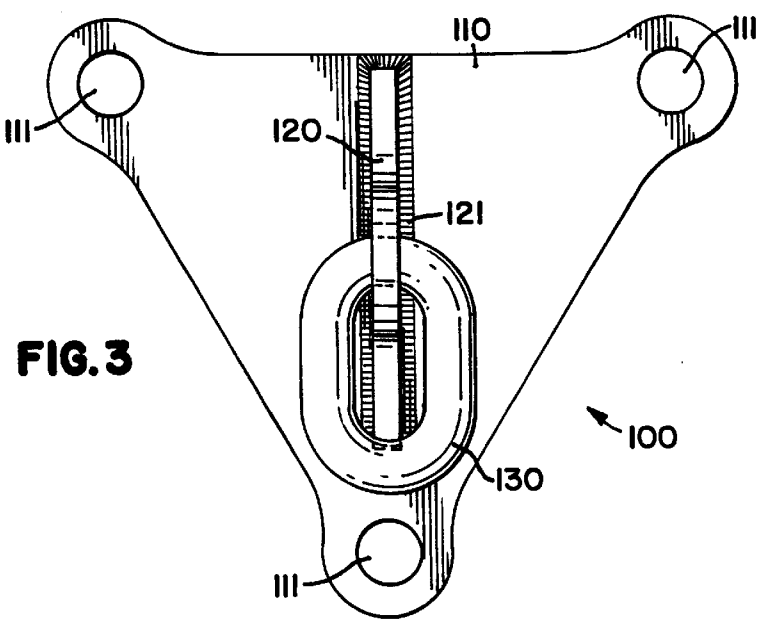
FIG. 3
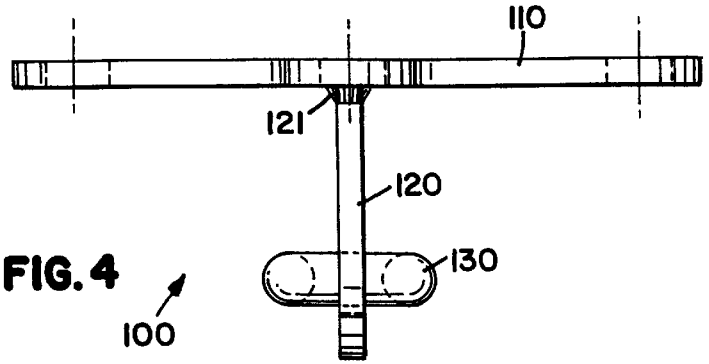
FIG. 4

95
96
97
98
99
100
130
135a
135b
136a
136b
137a
137b
137c
138a
138b

SAFETY LINE ANCHORAGE METHODS AND APPARATUS

FIELD OF THE INVENTION

The present invention relates to methods and apparatus for providing an anchorage between two members, such as a safety line and a support structure.

BACKGROUND OF THE INVENTION

Various occupations place people in precarious positions at relatively dangerous heights, thereby creating a need for fall-arresting safety apparatus. Such apparatus typically require a reliable safety line and reliable connections to both the support structure and persons working in proximity to the support structure. An object of the present invention is to provide an improved anchorage suitable for supporting a safety line in a variety of installation environments.

One known type of fall arrest system connects a horizontal line to a support structure to support individual worker safety lines without substantially interfering with the worker's movements. Examples of horizontal safety line systems are disclosed in U.S. Pat. No. 5,343,975 to Riches et al., U.S. Pat. No. 5,279,385 to Riches et al., U.S. Pat. No. 5,224,427 to Riches et al., and U.S. Pat. No. 4,790,410 to Sharp et al. Another object of the present invention is to provide an improved anchorage suitable for use at the ends of safety lines used in this type of system.

SUMMARY OF THE INVENTION

The present invention provides methods and apparatus for establishing a connection between two members. On a preferred embodiment of the present invention, a base plate is adapted to be mounted on a support structure, and a transverse plate extends outward from the base plate and supports a ring adapted to be connected to an end of a safety line. The ring is retained within a slot in the transverse plate, and a notch in the slot cooperates with tension in the safety line to discourage movement of the ring along the slot. Additional features and/or advantages of the present invention may become more apparent from the detailed description which follows.

BRIEF DESCRIPTION OF THE DRAWING

With reference to the Figures of the Drawing, wherein like numerals represent like parts and assemblies throughout the several views, FIG. 1 is a perspective view of an anchorage constructed according to the principles of the present invention;

FIG. 2 is a side view of the anchorage of FIG. 1;

FIG. 3 is a front view of the anchorage of FIG. 1;

FIG. 4 is an end view of the anchorage of FIG. 1;

DETAILED DESCRIPTION OF THE PREFERRED EMBODIMENT

Figures 5, 6, 7, 8:
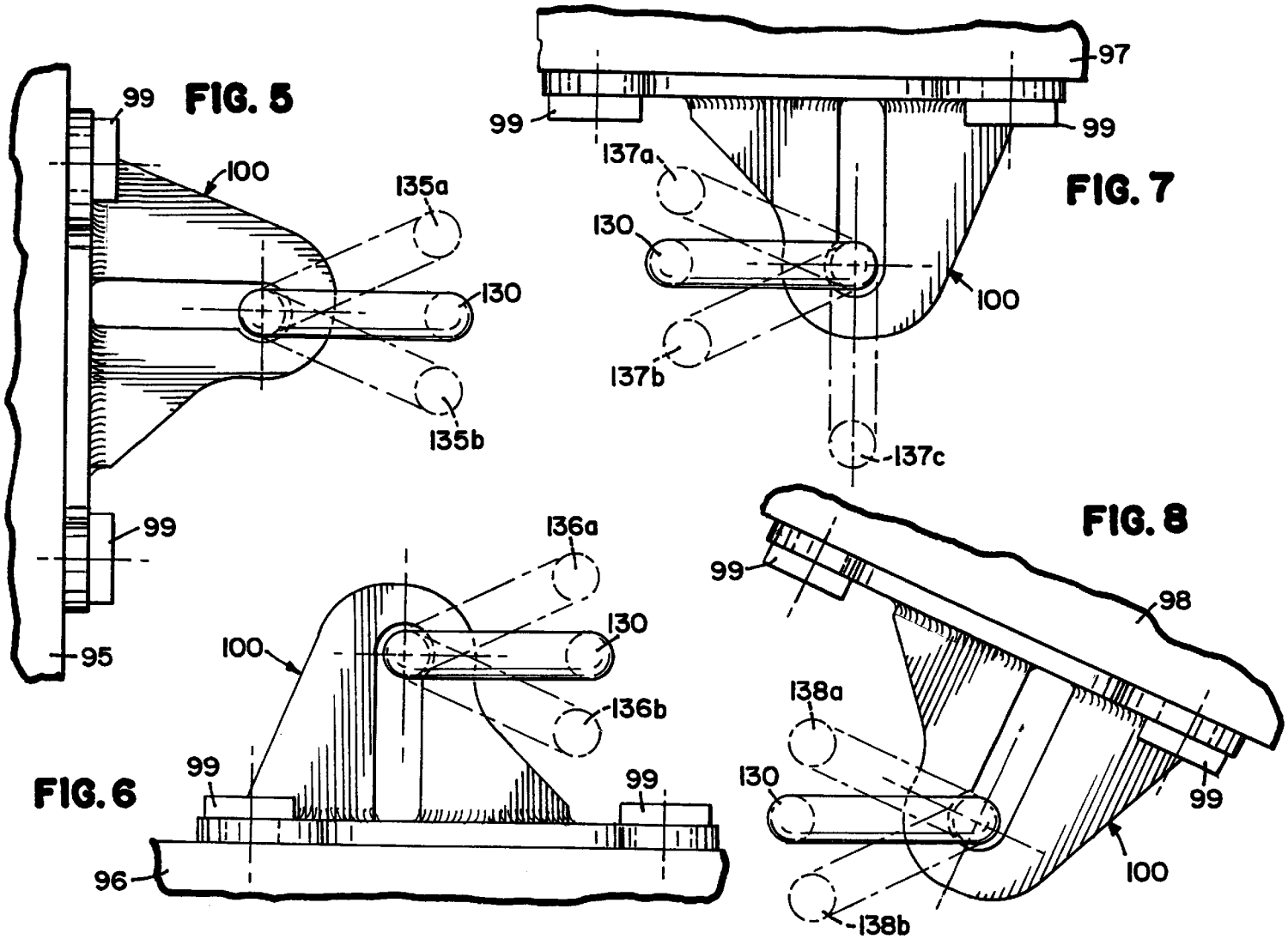
FIG. 5 is a side view of the anchorage of FIGS. 1–4 secured to a support structure extending vertically relative to an underlying ground surface.
FIG. 6 is a side view of the anchorage of FIGS. 1–4 secured on top of a support structure extending parallel to an underlying ground surface.
FIG. 7 is a side view of the anchorage of FIGS. 1–4 secured beneath a support structure extending parallel to an underlying ground surface.
FIG. 8 is a side view of the anchorage of FIGS. 1–4 secured to a support structure extending at an angle of approximately thirty degrees relative to an underlying ground surface.

A preferred embodiment anchorage or connector constructed according to the principles of the present invention is designated as 100 and in FIGS. 1–9. The connector 100 may be described in terms of a first plate 110, a second plate 120, and a ring 130.

The first plate 110 is preferably made of steel and generally triangular in shape. Holes 111 are formed through the plate 110 proximate each corner of the triangular perimeter. The holes 111 provide a means for bolting or otherwise securing the plate 111 to a support structure.

The second plate 120 is also preferably made of steel and generally triangular in shape. A slot 122 extends inward from one straight edge of the plate 120 toward an opposite corner of the triangular perimeter. A notch 123 extends into a sidewall of the slot 122, proximate the interior end thereof. A notch 125 extends into the edge of the plate 120 nearest the notch 123 in the slot 122.

The slot 122 is sized and configured to receive the ring 130, which is preferably made of steel and has a solid and uninterrupted perimeter. The notch 123 in the slot 122 is also sized and configured to receive the ring 130, and it discourages movement of the ring 130 along the slot 122 (especially when the ring 130 is connected to a taut safety line extending away from the plate 120). The notch 125 in the edge of the plate 120 provides clearance for the ring 130 and whatever is connected to the ring 130.

The connector 100 is assembled by inserting a distal portion of the second plate 120 through the ring 130 and then arranging the first plate 110 to span the open end of the slot 122 and thereby retain the ring 130 within the slot 122. The two plates 110 and 120 are arranged so that (1) the second plate 120 extends perpendicular to the first plate 110; (2) the interface between the first plate 110 and the second plate 120 extends between one of the holes 111 on the first plate 110 and the midpoint of an opposite, straight edge of the first plate 110; and (3) the notched edge of the plate 120 faces toward the hole 111 which is aligned with the interface. The plates 110 and 120 are secured to one another by welds 121 or other suitable means.

The resulting bracket 100 is both strong and durable. For example, the assembly process allows the ring 130 to be of solid construction. Also, the notch 123 in the slot 122 prevents deterioration of the bracket 100 which might otherwise result from repetitive movement of the ring 130 along the slot 122.

The preferred embodiment bracket 100 is also versatile, as suggested by the installation scenarios shown in FIGS. 5–8. FIG. 5 shows a support structure 95 having a vertically extending surface to which the bracket 100 is mounted by means of bolts 99. The ring 130 (depicted in solid lines) extends perpendicularly away from the vertical surface on the support structure 95, as if secured to a horizontally extending safety line (not shown). The ring **135*a* (depicted in dashed lines) extends away from the base plate at an angle of approximately thirty degrees relative to horizontal, as if secured to a safety line extending at a similar angle. The ring 135*b*** (depicted in dashed lines) extends away from the base plate at an angle of approximately negative thirty degrees relative to horizontal, as if secured to a safety line extending at a similar angle.

FIG. 6 shows a support structure 96 having an upwardly facing, horizontal surface to which the bracket 100 is mounted by means of bolts 99. The ring 130 extends parallel to the vertical surface on the support structure 96, as if secured to a horizontally extending safety line (not shown). The ring 136*a* extends away from the base plate at an angle of approximately thirty degrees relative to horizontal, as if secured to a safety line extending at a similar angle. The ring 136*b* extends away from the base plate at an angle of approximately negative thirty degrees relative to horizontal, as if secured to a safety line extending at a similar angle. In this particular installation scenario, the bracket 100 may be mounted on the edge of a rooftop or on top of a post, for example.

FIG. 7 shows a support structure 97 having an downwardly facing, horizontal surface to which the bracket 100 is mounted by means of bolts 99. The ring 130 extends parallel to the vertical surface on the support structure 97, as if secured to a horizontally extending safety line (not shown). The ring 137*a* extends away from the base plate at an angle of approximately thirty degrees relative to horizontal, as if secured to a safety line extending at a similar angle. In this particular installation scenario, the bracket 100 may be mounted to the underside of a beam, for example. The ring 137*b* extends away from the base plate at an angle of approximately negative thirty degrees relative to horizontal, as if secured to a safety line extending at a similar angle. The ring 137*c* extends perpendicularly away from the base plate, as if secured to a vertically extending safety line. This particular orientation is shown to emphasize that the bracket 100 can be arranged to accommodate any safety line orientation between horizontal and vertical, regardless of the orientation of the support structure to which the bracket 100 is secured. Yet another example is shown if FIG. 8, where the bracket 100 is bolted to a support structure 98 having an inclined surface. The rings 130, 138*a,* and 138*b* show how the bracket 100 can still support any generally horizontal safety line (within thirty degrees of horizontal).

Figure 9:
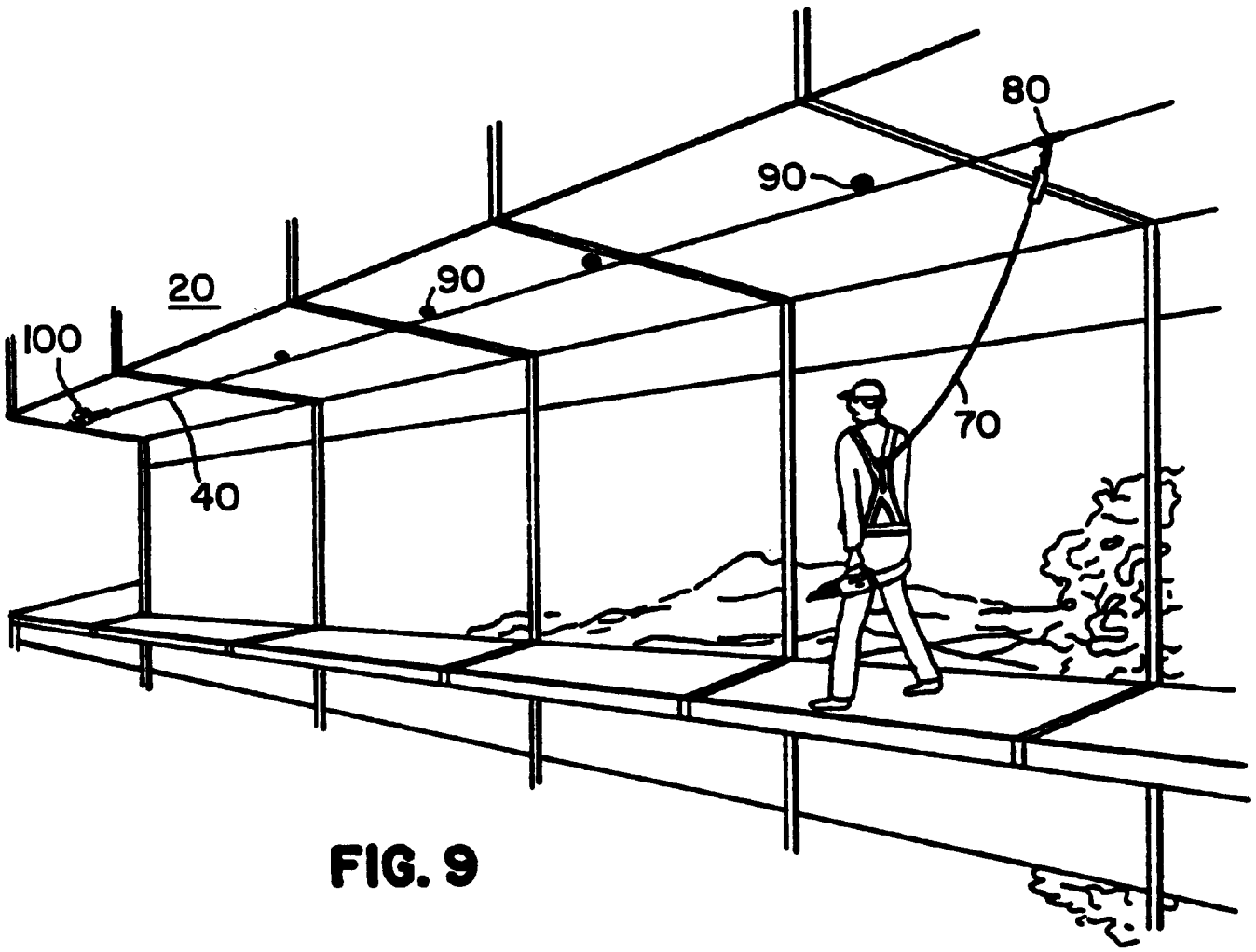
FIG. 9 is a perspective view of a horizontal safety line system including the anchorage of FIGS. 1–4.

FIG. 9 shows a preferred application for the bracket 100. In this application, the bracket 100 is a component of a horizontal safety line system of the type disclosed in U.S. Pat. No. 5,343,975 to Riches et al., U.S. Pat. No. 5,279,385 to Riches et al., U.S. Pat. No. 5,224,427 to Riches et al., and U.S. Pat. No. 4,790,410 to Sharp et al., which are incorporated herein by reference. As shown in FIG. 9, the bracket 100 is connected in series between a support structure 20 and the end of a horizontal safety line 40 (recognizing that an energy absorber may be connected in series with the safety line 40). The horizontal line 40 is also supported by intermediate brackets 90. A personal safety line 70 is interconnected between a worker's harness and a slotted coupling member 80 which moves along the horizontal line 40 and is capable of traversing the intermediate brackets 90.

The present invention may be described as an anchorage 100 of the type interconnected between a support structure 20 and a safety line 40, comprising: a base plate 110 adapted to be secured to the support structure 20; a transverse plate 120 secured to the base plate 110 and extending outward from the base plate 110; and a ring 130 captured within a slot 122 in the transverse plate 120 and surrounding an edge of the transverse plate 120, wherein the slot 122 is bounded by a sidewall having a notch 123 sized and configured to receive the ring 130. The slot 122 extends to an edge of the transverse plate 120, and the base plate 110 closes off the slot 122. The ring 130 is of solid, uninterrupted construction. Each said plate 110, 120 is steel, and the base plate 110 is secured to the transverse plate 120 by welding.

The present invention may also be described as a universal bracket 100 for connecting an end of a safety line 40 to a support structure 20, comprising: a securing means 99, 110 for securing the bracket 100 to the support structure 20; a receiving means 130 for receiving the end of the safety line 40; and a supporting means 120, 122, interconnected between the receiving means 130 and the securing means 99, 110, for supporting the receiving means 130 at a particular location and in a desired orientation regardless of how the support structure 20 is oriented relative to the desired orientation. The securing means 99, 110 includes a base plate 110 and at least one hole 111 extending through the base plate 110 to receive a fastener 99. The receiving means 130 includes a ring 130. The supporting means 120, 122 includes a transverse plate 120 extending outward from the base plate 110, and a slot 122 which extends inward from an edge of the transverse plate 120, and a notch 123 which extends into a sidewall of the slot 122 to seat the ring 130 within the slot 122.

The present invention may also be described as a method of making an anchorage 100 of the type interconnected between a support structure 20 and a safety line 40, comprising the steps of: forming a plate 120 with a slot 122 that extends inward from an edge of the plate 120; forming a solid, uninterrupted ring 130 to fit into the slot 122 and surround a portion of the plate 120; forming a base 110 to be secured to the support structure 20; and securing the base 110 to the plate 120 in such a manner that the ring 130 is captured within the slot 122. The securing step involves welding the base 110 to the plate 120.

Although the present invention has been described with reference to a preferred embodiment and a particular application, this disclosure will enable those skilled in the art to recognize additional embodiments and/or applications which fall within the scope of the present invention. For example, the present invention may be used in other systems and/or environments to support lines which may not extend generally horizontally, for example. Thus, the scope of the present invention should be limited only to the extent of the following claims.

What is claimed is:

1. An anchorage of the type interconnected between a support structure and a safety line, comprising:

a base plate adapted to be secured to the support structure;

a solid uninterrupted ring designed to permanently remain in a closed loop; and a transverse plate having a slot having an open end and a closed end, wherein first and second distal leg portions of the transverse plate are disposed on opposite sides of the slot, each of the distal leg portions being secured to the base plate to close off the slot and extend outward from the base plate with the ring captured within the slot in the transverse plate and forming a closed a loop about an edge of the transverse plate, wherein the slot is bounded by a sidewall having a notch sized and configured to receive the ring proximate an end of the slot opposite the base plate.

2. The anchorage of claim 1, wherein each said plate is steel, and the base plate is secured to the transverse plate by welding.

3. The anchorage of claim 1, wherein the ring is oval.

4. A method of making an anchorage of the type interconnected between a support structure and a safety line, comprising the steps of:

forming a plate with opposite first and second surfaces that define a plate thickness therebetween, and with a slot that extends through both surfaces from an interior portion of the plate to a peripheral edge of the plate, and with first and second distal leg portions disposed on opposite sides of the slot;

forming a solid, uninterrupted ring to fit into the slot and to form a permanently closed loop about a portion of the plate;

forming a base to be secured to the support structure;

inserting the ring into the slot; and securing each of the distal leg portions to the base in such a manner that the ring is captured within the slot.

5. The method of claim 4, wherein the securing step involves welding the base to the plate.

6. The method of claim 4, wherein the ring is formed into an oval shape.

7. The method of claim 4, wherein the plate is formed with a notch in a sidewall of the slot, and the notch is sized and configured to receive the ring.

8. The method of claim 4, wherein the base is formed with a first bolt hole extending through the base on a first side of the plate, and a second bolt hole extending through the base on an opposite, second side of the plate.

9. A method of making an anchorage of the type interconnected between a support structure and a safety line, comprising the steps of:

forming a plate to define a slot having an open end and a closed end, wherein first and second distal leg portions of the plate are disposed on opposite sides of the slot;

forming a ring to fit into the slot and to form a loop about a portion of the plate;

forming a base to be secured to the support structure;

inserting one of the distal leg portions through the ring; and securing each of the distal leg portions to the base in such a manner that the ring is captured within the slot.

10. The method of claim 9, wherein the securing step involves welding each of the distal leg portions to the base.

11. The method of claim 9, wherein the plate is formed with a notch in the slot proximate the closed end.

12. The method of claim 11, wherein the plate is formed with a perimeter which includes a concave portion proximate the notch.

13. The method of claim 9, wherein the plate is secured to the base in such a manner that the slot extends perpendicularly away from the base.

14. The method of claim 9, wherein the plate is secured to the base in such a manner that the plate extends perpendicularly away from the base.

15. The method of claim 9, wherein the plate has opposite faces which define a plate thickness therebetween, and the slot extends through both faces and inward from a peripheral edge of the plate.

16. The method of claim 8, wherein the base is formed with bolt holes extending through the base, and the plate is secured to the base in such a manner that respective bolts holes are disposed on opposite sides of the plate.

17. The method of claim 8, wherein the ring is formed to remain in a permanently closed loop.

18. The method of claim 8, wherein the ring is formed into an oval shape.

* * * * *

UNITED STATES PATENT AND TRADEMARK OFFICE

CERTIFICATE OF CORRECTION

PATENT NO. : 6,227,329 B1
DATED : May 8, 2001
INVENTOR(S) : Bernard R. Ador

It is certified that error appears in the above-identified patent and that said Letters Patent is hereby corrected as shown below:

Title page,
References Cited, U.S. PATENT DOCUMENTS, delete "Bongiolanns" and insert therefore -- Bongiovanni et al --

Column 6,
Lines 22, 25, and 27, delete "8" and insert therefore -- 9 --

Signed and Sealed this

Eighth Day of January, 2002

*Attest:*

*Attesting Officer*

JAMES E. ROGAN
*Director of the United States Patent and Trademark Office*